United States Patent [19]

Massaux et al.

[11] Patent Number: 4,881,940

[45] Date of Patent: Nov. 21, 1989

[54] GRANULATED MAGNESIUM MONOPEROXYPHTHALATE COATED WITH FATTY ACID FOR PREVENTION OF DYE DAMAGE OF BLEACH SENSITIVE FABRICS

[75] Inventors: Jean Massaux, Olne; Pierre Lambert, Cortil-Wodon; Jacques Noiret, Vivegnis, all of Belgium

[73] Assignee: Colgate-Palmolive Co., Piscataway, N.J.

[21] Appl. No.: 227,440

[22] Filed: Jul. 25, 1988

Related U.S. Application Data

[63] Continuation of Ser. No. 67,053, Jun. 25, 1987, abandoned.

[51] Int. Cl.[4] ..... D06L 3/02; D06L 3/04

[52] U.S. Cl. ..... 8/111; 252/95; 252/186.25; 252/186.26; 252/99

[58] Field of Search ..... 252/95, 96, 100, 186.25, 252/186.26; 252/186.25, 186.26; 8/111

[56] References Cited

U.S. PATENT DOCUMENTS

| | | | |
|---|---|---|---|
| 3,847,830 | 11/1974 | Williams et al. | 252/186 |
| 3,908,045 | 9/1975 | Alterman | 252/103 |
| 4,009,113 | 2/1977 | Green et al. | 252/99 |

FOREIGN PATENT DOCUMENTS 0027693 4/1981 European Pat. Off. .

*Primary Examiner*—Prince E. Willis
*Assistant Examiner*—John F. McNally
*Attorney, Agent, or Firm*—Bernard Lieberman; Murray M. Grill; Robert C. Sullivan

[57] ABSTRACT

A bleaching agent is described particularly effective for low temperature bleaching of laundry while avoiding concomitant dye damage of bleach-sensitive dyed fabrics. The bleaching agent comprises particles of monoperoxyphthalic acid (MPPA) and/or a water-soluble salt thereof, said particles being at least partially coated with an effective amount of a substantially aliphatic fatty acid mixture comprised of at least 16% and no more than about 40%, by weight, of fatty acids having a chain length of from 20 to 22 carbon atoms, said mixture being substantially free of fatty acids having less than 14 carbon atoms.

17 Claims, No Drawings

GRANULATED MAGNESIUM MONOPEROXYPHTHALATE COATED WITH FATTY ACID FOR PREVENTION OF DYE DAMAGE OF BLEACH SENSITIVE FABRICS

This application is a continuation of application Ser. No. 067,053, filed 6/25/87, now abandoned.

BACKGROUND OF THE INVENTION

This invention relates, in general, to bleaching agents, their manufacture and use in detergent compositions, and their application to laundry operations. More specifically, the invention relates to bleaching agents, and bleaching detergent compositions containing such agent, which provide effective low-temperature bleaching of fabrics while substantially avoiding dye damage to bleach-sensitive fabrics.

Peroxygen compounds, such as perborates and percarbonates, which form hydrogen peroxide in aqueous solution are commonly used in bleaching and washing compositions to promote the bleaching of soiled fabrics. Washing compositions of this type are particularly prevalent in Europe and other countries which use relatively high washing temperatures, often near the boiling point of water, for laundering in automatic washing machines. In the United States, on the other hand, the use of peroxygen compounds in washing and bleaching compositions has been relatively limited due to the fact that such compounds are not optimally effective at temperatures below 80° C., the range of washing temperatures in the United States being generally from about 30° C. to 60° C. Moreover, even in Europe and those other countries where much higher washing temperatures are conventional, there is a trend towards washign at temperatures from about ambient to 60° C. because of the increasing use of synthetic fibers in clothing manufacture, materials which do not readily tolerate elevated washing temperatures.

In an effort to provide enhanced bleaching activity at lower temperatures, bleach activators of different types have been employed in combination with the peroxygen compounds, the interaction of the activator and peroxygen compound forming a peroxyacid in the wash solution which is the active species for bleaching. Activators of this type are extensively described in the prior art.

Another approach has been to use pre-formed organic peroxyacids to effect bleaching in laundry wash solutions. Monoperoxyphthalic acid (also referred to herein as MPPA for convenience) and, in particular, its magnesium salt is described as an effective bleaching agent in European Patent Application No. 0,027,693, published Apr. 29, 1983. However, as a practical matter, the use of MPPA and/or its magnesium salt for low temperature bleaching has a significant disadvantage with regard to certain dyed fabrics which are particularly sensitive to such bleach and interact therewith in the wash solution. This type of interaction frequently results in dye-damaged fabrics, the resultant effect being commonly referred to as "pin point" bleaching or spotting. The phenomenon of "pin point" spotting is believed to be due, in part, to a localized high concentration of bleach at the fabric surface where it reacts with a dye which is especially sensitive to such bleach and forms a pattern of bleached "spots" in a portion of the fabric. Consequently, there is a need in the art for a bleaching agent which is particularly active at low washing temperatures, yet safe enough for use such that it substantially avoids fabric damage by pin point spotting.

In U.S. Pat. No. 3,847,830 there is disclosed a peroxygen containing composition comprised of a particulate "normally unstable" peroxygen or peroxyacid compound enveloped by a layer consisting of less than 15%, by weight, of a water insoluble agent. Among the recommended enveloping agents are fatty acids containing from 8 to 26 carbon atoms. The function of the layer enveloping the peroxygen or peroxyacid compound is to enhance the storage stability of such compounds by preventing their decomposition in a humid environment such as typically generated in a sealed container wherein a peroxygen or peroxyacid compound is in admixture with a particulate detergent composition.

U.S. Pat. Nos. 4,385,008 and 4,403,994 address themselves to the specific problems of storage stability and impact sensitivity of the magnesium salts of peroxycarboxylic acid compounds. The patents disclose the combination of magnesium monoperoxyphthalic, for example, with a desensitizing diluent selected from among broad classes of materials including hydrocarbon waxes, fatty acids, aromatic acids and esters, starch, cellulose and protein. With specific regard to the fatty acids, the patents state that "although any aliphatic acid can be used, for practical purposes, the acid normally contains from 10 to 26 carbon atoms . . . ". Lauric acid (a 12 carbon atoms acid) is said to be especially preferred for this purpose.

U.S. Pat. No. 4,655,780 to Chun et al addresses itself to the problem of pinhole bleach damage and describes chlorine bleaching particles encapsulated in a blend of fatty acid soaps of specified chain length. The effective soap blend is said to be a mixture of $C_{12}$–$C_{14}$ fatty acid soap with $C_{16}$–$C_{18}$ fatty acid soap. A binder is described as an "essential element" of the described bleaching composition. Lauric acid (a $C_{12}$ acid) is said to be "the binder of choice."

Accordingly, while encapsulated chlorine bleach particles have been described in the art to overcome "pin point" spotting, and while the general combination of magnesium monoperoxyphthalate (MMPP) with a diluent or outer layer has been contemplated, the problem of "pin point" spotting of bleach-sensitive fabrics attendant to the use of MMPP for low temperature bleaching remains a problem yet to be addressed or solved.

SUMMARY OF THE INVENTION

The present invention provides, in one aspect thereof, a bleaching agent particularly effective for low temperature bleaching of laundry while substantially avoiding concomitant dye damage of bleach-sensitive dyed fabrics comprising: particles of monoperoxyphthalic acid (MPPA) and/or a water-soluble salt, said particles being at least partially coated with an effective amount of a substantially aliphatic fatty acid mixture comprised of at least about 16%, and no more than about 40%, by weight, of fatty acids having a chain length of from 20 to 22 carbon atoms, said mixture being substantially free of fatty acids having less than 14 carbon atoms.

The bleaching detergent composition of the invention comprises the above-defined bleaching agent in combination with one or more surface active detergent compounds and detergent builder salts. In accordance with the process of the invention, bleaching of stained and/or soiled materials is effected by contacting such materials with an aqueous solution of the above-defined compositions.

The present invention is predicated on the discovery that effective low temperature bleaching of laundry can be achieved while substantially avoiding the undersired occurrence of pin-point spotting of bleach-sensitive fabrics by providing at least a partial coating of a specifically defined fatty acid mixture to particles of MPPA bleach (or a water-soluble salt thereof). The chain length distribution or the fatty acid mixture is such that it contains at least 16%, and no more than about 40%, by weight, of $C_{20}$–$C_{22}$ aliphatic fatty acids and is substantially free of fatty acids having less than 14 carbon atoms, such as, lauric acid. By way of contrast, it is noted that lauric acid is a preferred diluent in the prior art for MPPA bleach as per the aforementioned U.S. Pat. Nos. 4,385,008 and 4,403,994.

DETAILED DESCRIPTION OF THE INVENTION

Monoperoxyphthalic acid and/or one or more of its water-soluble salts are the essential bleaching compounds which provide bleaching activity in the compositions of the invention. Although MPPA provides acceptable bleaching activity, it has the disadvantage of relatively poor stability when stored in admixture with other components ordinarily present in household detergent compositions. Hence, for purposes of stability, the magnesium salt of MPPA is preferably employed in the compositions of the invention, namely, magnesium monoperoxyphthalate. The alkali metal, calcium or barium alkaline earth and/or ammonium salts of MPPA may also be employed in the bleaching and laundering compositions herein described, although such salts are generally less preferred from the standpoint of stability than the aforementioned magnesium salt.

The production of MPPA is generally effected by the reaction of hydrogen peroxide and phthalic anhydride. The resultant MPPA an then be used to produce magnesium monoperoxyphthalate by reaction with a magnesium compound in the presence of an organic solvent. A detailed description of the production of MPPA and its magnesium salt is set forth on pages 7 to 10, inclusive, of European Patent Publication No. 0,027,693, published Apr. 29, 1981, the aforementioned pages 7 to 10 being incorporated herein by reference.

A fatty acid mixture is used to at least partially coat the particles of MPPA or a water-soluble salt thereof as hereinafter described. The fatty acid mixture is predominantly, or preferably entirely, aliphatic fatty acids although a minor amount of unsaturated fatty acids may also be present in the mixture in accordance with the invention. At least 16%, by weight of the acid mixture is comprised of fatty acids containing from 20 to 22 carbon atoms, e.g., arachidic and behenic acids. The maximum percentage of $C_{20}$–$C_{22}$ fatty acids in the acid mixture is about 40%, and as a practical matter. it has been found that a $C_{20}$–$C_{22}$ acid fraction of from about 22% to 34%, by weight, is generally effective for the elimination of pin-point spotting.

A preferred fatty acid mixture has the following chain length distribution in accordance with the invention:

| Carbon Chain Length | Distribution (Weight Percent) |
|---|---|
| $C_{12}$ | 0% |

-continued

| Carbon Chain Length | Distribution (Weight Percent) |
|---|---|
| $C_{14}$ | 10.5 |
| $C_{15}$ | 0.8 |
| $C_{16}$ | 30.5 |
| $C_{17}$ | 1.4 |
| $C_{18}$ | 27.6 |
| $C_{19}$ | 0.9 |
| $C_{20}$ | 18.5 |
| $C_{22}$ | 9.8 |

A preferred fatty acid mixture for coating particles of MPPA or a salt of MPPA in accordance with the invention is marketed by Oleofina (Belgium), Hehkel (Germany) and Mira Lanza (Italy). This type of fatty acid mixture has a molecular weight of about 287 a melting point of about 50° C., and the fraction of $C_{20}$–$C_{22}$ fatty acids is about 28% with preferably no fatty acid having less than 14 carbon atoms.

The method of coating the particulate MPPA or MPPA salt with the fatty acid mixture is not critical. Preferably, the fatty acid mixture is sprayed in molten form onto the heated and agitated particles of MPPA bleach. The process may be continuous or discontinuous with the particles being agitated mechanically or in a fluidized bed. It is advantageous to spray the molten fatty acid mixture at a temperature of about 10° C. above its melting point while the particulate MPPA or MPPA salt is heated to about 10° C. below said melting point. Typically, a fatty acid mixture having the preferred chain length distribution described above has a melting point of about 50° C. The particle size of MPPA or its salt may suitably vary from about 16 mesh to about 170 mesh corresponding to about 1180 microns to 90 microns. A particle size of from about 18 to 140 mesh is preferred.

The total amount of fatty acid mixture used to partially envelope or coat the monoperoxyphthalate bleach particle is desirably from about 25 to 35%, by weight, of the coated particles. The suitable level of coating is generally determined by the degree of color protection i.e., avoidance of pin-point spotting, required. For the majority of bleach-sensitive dyed fabrics, a coating of about 27 to 30%, by weight, of the coated particles of MPPA or its water-soluble salt, will insure maximum color or dye protection.

The bleaching agent as herein described may be formulated as an separate bleach product, or alternatively, may be employed in a built detergent composition. Thus, the bleaching agent of the invention may be incorporated into a laundering detergent compositions containing surface active agents, such as, anionic, cationic, nonionic, ampholytic and zwitterionic detergents and mixtures thereof. Additionally, the bleaching detergent compositions herein described may include conventional additives used in the fabric washing art, such as, binders, fillers, builder salts, proteolytic enzymes, optical brighteners, perfumes, dyes, corrosion inhibitors, anti-redeposition agents, foam stabilizers and the like, all of which may be added in varying quantities depending on the desired properties of the bleaching composition and their compatibility with such composition.

When the instant bleaching agents are incorporated into a conventional laundering composition and are thus provided as a fully formulated bleaching detergent composition, the latter compositions will comprise the following: from about 5 to 50%, by weight, of the instant bleaching agents; from about 5 to 50%, by weight, of a detergent surface active agent, preferably from about 5 to 30%, by weight; and from about 5 to 80%, by weight, of a detergent builder salt which can also function as a buffer to provide the requisite pH range when the laundering composition is added to water. The aqueous wash solutions will have a pH range of from about 7 to 12, preferably from about 8 to 10, and most preferably from about 8.5 to 9. A preferred amount of the builder salt is from about 20% to about 65%, by weight, of the composition. The balance of the composition will predominantly comprise water, filler salts, such as, sodium sulfate, and optionally, minor additives, such as optical brighteners, perfumes, dyes, anti-redeposition agents and the like.

Among the anionic surface active agents useful in the present invention are those surface active compounds which contain an organic hydrophobic group containing from about 8 to 26 carbon atoms and preferably from about 10 to 18 carbon atoms in their molecular structure and at least one water-solubilizing group selected from the group of sulfonate, sulfate, carboxylate, phosphonate and phosphate so as to form a water-soluble detergent.

Examples of suitable anionic detergents include soaps, such as, the water-soluble salts (e.g., the sodium, potassium, ammonoium and alkanol-ammonium salts) of higher fatty acids or resin salts containing from about 8 to 20 carbon atoms and preferably 10 to 18 carbon atoms. Suitable fatty acids can be obtained from oils and waxes of animal or vegetable origin, for example, tallow, grease, coconut oil and mixtures thereof. Particularly useful are the sodium and potassium salts of the fatty acid mixtures derived from coconut oil and tallow, for example, sodium coconut soap and potassium tallow soap.

The anionic class of detergents also includes the water-soluble sulfated and sulfonated detergents having an aliphatic, preferably an alkyl radical containing from about 8 to 26, and preferably from about 12 to 22 carbon atoms. (The term "alkyl" includes the alkyl portion of the higher acyl radicals). Examples of the sulfonated anionic detergents are the higher alkyl mononuclear aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are the olefin sulfonates including long chain alkene sulfonates, long chain hydroxyalkane sulfonates or mixtures of alkene sulfonates and hydroxyalkane sulfonates. The olefin sulfonate detergents may be prepared in a conventional manner by the reaction of $SO_3$ with long chain olefins containing from about 8 to 25, and preferably from about 12 to 21 carbon atoms, such olefins having the formula $RCH{=}CHR_1$ wherein R is a higher alkyl group of from about 6 to 23 carbons and $R_1$ is an alkyl group containing from about 1 to 17 carbon atoms, or hydrogen to form a mixture of sultones and alkene sulfonic acids which is then treated to convert the sultones to sulfonates. Other examples of sulfate or sulfonate detergents are paraffin sulfonates containing from about 10 to 20 carbon atoms, and preferably from about 15 to 20 carbon atoms. The primary paraffin sulfonates are made by reacting long chain alpha olefins and bisulfites. Paraffin sulfonates having the sulfonate group distributed along the paraffin chain are shown, for example, in the U.S. Nos. 2,503,280; 2,507,088; 3,260,741; and 3,372,188.

Other suitable anionic detergents are sulfated ethoxylated higher fatty alcohols of the formula $RO(C_2H_4O)_mSO_3M$, wherein R is a fatty alkyl of from 10 to 18 carbon atoms, m is from 2 to 6 (preferably having a value from about 1/5 to ½ the number of carbon atoms in R) and M is a solubilizing salt-forming cation, such as an alkali metal, ammonium, lower alkylamino or lower alkanolamino, or a higher alkyl benzene sulfonate wherein the higher alkyl is of 10 to 15 carbon atoms. The proportion of ethylene oxide in the polyethoxylated higher alkanol sulfate is preferably 2 to 5 moles of ethylene oxide groups per mole of anionic detergent, with three moles being most preferred, especially when the higher alkanol is of 11 to 15 carbon atoms. To maintain the desired hydrophile-lipophile balance, when the carbon atom content of the alkyl chain is in the lower portion of the 10 to 18 carbon atom range, the ethylene oxide content of the detergent may be reduced to about two moles per mole whereas when the higher alkanol is of 16 to 18 carbon atoms in the higher part of the range, the number of ethylene oxide groups may be increased to 4 or 5 and in some cases to as high as 8 or 9. Similarly, the salt-forming cation may be altered to obtain the best solubility. It may be any suitably solubilizing metal or radical but will most frequently be alkali metal, e.g., sodium, or ammonium. If lower alkylamine or alkanolamine groups are utilized the alkyls and alkanols will usually contain from 1 to 4 carbon atoms and the amines and alkanolamines may be mono-, di-, and tri-substituted, as in monoethanolamine, diisopropanolamine and trimethylamine. A preferred polyethoxylated alcohol sulfate detergent is available from Shell Chemical Company and is marketed as Neodol 25-3S.

The most highly preferred water-soluble anionic detergent compounds are the ammonium and substituted ammonium (such as mono, di and tri-ethanol-amine), alkali metal (such as, sodium and potassium) and alkaline earth metal (such as, calcium and magnesium) salts of the higher alkyl benzene sulfonates, olefin sulfonates and higher alkyl sulfates. Among the above-listed anionics, the most preferred are the sodium linear alkyl benzene sulfonates (LABS), and especially those wherein the alkyl group is a straight chain alkyl radical of 12 or 13 carbon atoms.

The nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups.

The nonionic detergent employed is preferably a poly-lower alkoxylated higher alkanol wherein the alkanol is of 10 to 18 carbon atoms and wherein the number of moles of lower alkylene oxide (of 2 or 3 carbon atoms) is from 3 to 12. Of such materials it is preferred to employ those wherein the higher alkanol is a higher fatty alcohol of 11 to 15 carbon atoms and which contain from 5 to 9 lower alkoxy groups per mole. Preferably lower alkoxy is ethoxy but in some instances it may be desirably mixed with propoxy, the latter, if present, usually being a minor (less than 50%) constituent. Exemplary of such compounds are those wherein the alkanol is of 12 to 15 carbon atoms and which contain about 6 ethylene oxide groups per mole, e.g., Neodol® 25-7 and Neodol 23-6.5, which products are made by Shell Chemical Company, Inc. The former is a condensation product of a mixture of higher fatter alcohols averaging about 12 to 15 carbon atoms, with about 7 moles of ethylene oxide and the latter is a corresponding mixture wherein the carbon atom content of the higher fatty alcohol is 12 to 13 and the number of ethylene oxide groups per mole averages about 6.5. The higher alcohols are primary alkanols. Other examples of such detergents include Tergitol® 15-S-7 nd Tergitol 15-S-9, both of which are linear secondary alcohol ethoxylates made by Union Carbide Corporation. The former is a mixed ethoxylation product of an 11 to 15 carbon atom linear secondary alkanol with seven moles of ethylene oxide and the latter is a similar product and with nine moles of ethylene oxide being reacted. Also useful in the present compositions are the higher molecular weight nonionics, such as Neodol 45-11, which are similar ethylene oxide condensation products of higher fatty alcohols, the higher fatty alcohol being of 14 to 15 carbon atoms and the number of ethylene oxide groups per mole being about 11. Such products are also made by Shell Chemical Company.

Zwitterionic detergents such as the betaines and sulfobetaines having the following formula are also useful:

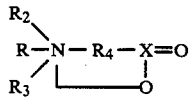

wherein R is an alkyl group containing from about 8 to 18 carbon atoms, $R_2$ and $R_3$ are each an alkyl or hydroxyalkyl group containing about 1 to 4 carbon atoms, $R_4$ is an alkylene or hydroxyalkylene group containing 1 to 4 carbon atoms, and X is C or S:O. The alkyl group can contain one or more intermediate linkages such as amido, ether, or polyether linkages or nonfunctional substituents such as hydroxyl or halogen which do not substantially affect the hydrophobic character of the group. When X is C, the detergent is called a betaine; and when X is S:O, the detergent is called a sulfobetaine or sultaine.

Cationic surface active agents may also be employed. They comprise surface active detergent compounds which contain an organic hydrophobic group which forms part of a cation when the compound is dissolved in water, and an anionic group. Typical cationic surface active agents are amine and quaternary ammonium compounds.

Examples of suitable synthetic cationic detergents include: normal primary amines of the formula $RNH_2$ wherein R is an alkyl group containing from about 12 to 15 atoms; diamines having the formula $RNHC_2H_4NH_2$ wherein R is an alkyl group containing from about 12 to 22 carbon atoms, such as N-2-aminoethyl-stearyl amine and N-2 aminoethyl myristyl amine; amide-linked amines such as those having the formula $R_1CONHC_2H_4NH_2$ wherein $R_1$ is an alkyl group containing about 8 to 20 carbon atoms, such as N-2-amino ethylstearyl amide and N-amino ethylmyristyl amide; quaternary ammonium compounds wherein typically one of the groups linked to the nitrogen atoms is an alkyl group containing about 8 to 22 carbon atoms and three of the groups linked to the nitrogen atom are alkyl groups which contain 1 to 3 carbon atoms, including alkyl groups bearing inert substituents such as phenyl groups, and there is present an anion such as halogen, acetate, methosulfate, etc. The alkyl group may contain intermediate linkages such as amide which do not substantially affect the hydrophobic character of the group, for example, stearyl amido propyl quaternary ammonium chloride. Typical quaternary ammonium detergents are ethyl-dimethyl-stearyl-ammonium chloride, benzyl-dimethyl-stearyl ammonium chloride, trimethyl-stearyl ammonium chloride, trimethyl-cetyl ammonium bromide, dimethyl-ethyl-lauryl ammonium chloride, dimethyl-propyl-myristyl ammonium chloride, and the corresponding methosulfates and acetates.

Ampholytic (or amphoteric) detergents are also suitable for the invention. Ampholytic detergents are well known in the art and many operable detergents of this class are disclosed by Schwartz, Perry and Berch in the aforementioned "Surface Active Agents and Detergents." Examples of suitable ampholytic detergents include: alkyl betaiminodipropionates, $RN(C_2H_4COOM)_2$; alkyl beta-amino propionates, $RN(H)_2C_2H_4COOM$; and long chain detergents having the general formula:

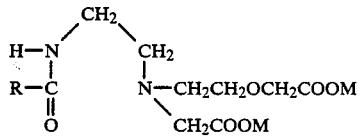

wherein in each of the above formulae R is an acyclic hydrophobic group containing from about 8 to 18 carbon atoms and M is a cation to neutralize the charge of the anion.

The bleaching detergent compositions of the invention optionally contain a detergent builder of the type commonly used in detergent formulations. Useful builders include any of the conventional inorganic water-soluble builder salts, such as, for example, water-soluble salts of phosphates, pyrophosphates, orthophosphates, polyphosphates, silicates, carbonates, and the like. Organic builders include water-soluble phosphates, polyphosphonates, polyhydroxysulfonates, polyacetates, carboxylics, polycarboxylates, succinates and the like.

Specific examples of inorganic phosphate builders include sodium and potassium tripolyphosphates, pyrophosphates and hexametaphosphates. The organic polyphosphates specifically include, for example, the sodium and potassium salts of ethane 1-hydroxyl-1,1-diphosphonic acid, ethane-1-1,2-triphosphonic acid and diethylene triamine pentamethylene phosphonic acid. Examples of these and other phosphorous builder compounds are disclosed in U.S. Pat. Nos. 3,213,030; 3,422,021; 3,422,137 and 4,225,452. Pentasodium tripolyphosphate and tetrasodium pyrophosphate are especially preferred water-soluble inorganic builders.

Specific examples of non-phosphorous inorganic builders include water-soluble inorganic carbonate, bicarbonate and silicate salts. The alkali metal, for example, sodium and potassium, carbonates, bicarbonates and silicates are particularly useful herein.

Water-soluble organic builders are also useful. For example, the alkali metal, ammonium and substituted ammonium acetates, carboxylates, polycarboxylates and polyhydroxysulfonates are useful builders for the compositions and processes of the invention. Specific examples of acetate and polycarbosylate builders include sodium, potassium, lithium, ammonium and substituted ammonium salts of ethylene diaminetetracetic acid, nitrilotriacetic acid, benzene polycarboxylic (i.e. penta- and tetra-) acids, carboxymethoxysuccinic acid and citric acid.

Water-insoluble builders may also be used, particularly, the complex silicate and more particularly, the complex sodium alumino silicates such as, zeolite, e.g., zeolite 4A, a type of zeolite molecule wherein the univalent cation is sodium and the pore size is about 4 Angstroms. The preparation of such type zeolite is described in U.S. Pat. No. 3,114,603. The zeolites may be amorphous or crystalline and have water of hydration as known in the art.

The use of an inert, water-soluble filler salt is often desirable in the laundering compositions of the invention. A preferred filler salt is an alkali metal sulfate, such as, potassium or sodium sulfate, the latter being especially preferred.

EXAMPLE 1

Bleaching agents were prepared by coating particles of magnesium monoperoxyphthalate (MMPP) with different fatty acid mixtures in accordance with the following procedure which was used to prepare MMPP particles containing a 28%, by weight, coating of fatty acid mixture:

The percentage of coating is calculated as follows:

$$\frac{\text{Weight (gms) fatty acid}}{\text{Weight (gms) fatty acid + weight (gms) } MMPP} \times 100$$

Starting materials: the fatty acid mixture; magnesium monoperoxyphthalate purchased from Interox (England) under the trade designation "H-48".

For a 28% coating, 78 grams of the fatty acid mixture selected is weighed and then heated to about 10° C. above its melting point (for fatty acid HMW this corresponds to a temperature of about 60° C.). Two hundred grams (200 g) of MMPP are preheated separately in a onoe liter beaker to a temperature about 10° C. below the melting point of said fatty acid mixture (for fatty acid HMW this corresponds to a temperature of about 40° C.).

Coating consists of pouring slowly and continuously the melted fatty acid mixture onto the particles of MMPP while agitating the MMPP particles with a mechanical agitator such as an axial flow impeller at a speed of about 250–300 rpm. During the coating operation, the temperature of the MMPP particles are maintained at about 10° C. below the melting point of the fatty acid mixture. The coating procedure is carried out in a period of less than 30 minutes.

EXAMPLE 2

A bleaching detergent composition was prepared by mixing the bleaching agent of Example 1 with a granular detergent composition prepared by conventional spray-drying, the resultant mixture having the following approximate composition:

TABLE 1

| COMPONENT | Weight Percent |
|---|---|
| Sodium linear $C_{10}$—$C_{12}$ alkyl benzene sulfonate | 5 |
| Ethoxylated $C_{11}$—$C_{18}$ alcohol (11 moles of EO per mole alcohol) | 3 |
| Soap (sodium salt of $C_{12}$—$C_{22}$ carboxylic acids) | 2 |
| Sodium silicate (1 $Na_2O$:2 $Sio_2$) | 3 |
| Pentasodium tripolyphosphate (TPP) | 40 |
| Sodium Salt of diethylene triamine pentamethylene phosphonic acid (DTPMP) | 0.5 |
| Enzyme[a] | 0.4 |
| Optical brighteners | 0.2 |
| Coated Mg salt of MPPA[b] | 7.0 |
| Perfume | 0.18 |
| Sodium Sulfate | 22 |
| Water | q.s. |

Notes
[a]A proteolytic enzyme purchased as Alcalase 2M (2 anson unit/gram) or as Maxatase P.
[b]The bleaching agent described in Example 1

Bleaching tests were carried out to measure the effect on pin-point spotting of bleaching agents coated with various fatty acid mixtures. Accordingly, the following fatty acids were applied to particles of magnesium monoperoxyphthalate (MMPP) following the procedure of Example 1.

1- Fatty Acid HMW - A type of hydrogenated fatty acid mixture marketed by Oleofina of Belgium among other companies. Fatty acid HMW types I and II identified in Table 2 reflect differences in the chain length distribution of the product for different batches purchased from a single supplier, or for the same nominal product purchased from different suppliers.

2- Radiacid 60 - A fatty acid mixture marketed by Oleofina of Belgium.

3- Radiacid 161 - Same as above

4- Tallow-Coco - a 75/25 wt. % mixture of tallow/-coco fatty acids.

5- Coco/palm - A mixture of coco and palm distilled fatty acids, the percentage of coco and palm fatty acids being determined.

Bleaching detergent compositions as described in Table 1 were prepared with different bleaching agents, each bleaching agent consisting of particles of MMPP coated with a different fatty acid mixture. The bleaching agents prepared with the Radiacid 60, Radiacid 161, tallow/coco and coco/palm fatty acid mixtures are not in accordance with the invention because of the chain length distribution of such fatty acid mixtures.

The test procedure was as follows: A powder dose of 180 grams of the bleaching detergent composition to be tested was added to a European washing machine (Thomson T59-44), such dosage being calculated to deliver about 0.44% available oxygen (Avox.) to the wash water. Washes were run at 30° C. for 24 consecutive cycles. To magnify dye-damage effects, three blue tracer cloths which are extremely sensitive to MMPP were introduced at the beginning of each cycle and distributed in the washload by placing one at the top, the second in the middle and the third at the bottom. After each of the 24 wash test cycles, the blue tracer cloths were visually inspected and assigned a rating depending on the level of pin-point spotting observed. The ratings were as follows: Class I - a completely safe wash with no dye damage discernible; Class II - minimum dye damage observed; Class III - medium level of dye damage present; Class IV - high level of dye damage present; Class V - extremely high level of dye damage present.

The results of these bleaching tests are summarized in Table 2. The fatty acid mixtures used to coat the bleaching agents are characterized in terms of their respective chain length distribution, and the presence of pin-point spotting is noted as percentages for a particular class of dye damage based on the total number of washes evaluated (24).

Based on the data in the Table it is evident that coating magnesium monoperoxyphthalate particles with a fatty acid mixture reduces the risk of severe pin point bleaching (Classes IV and V) as compared to the control example which consisted of uncoated particles of MMPP. However, as indicated in the Table, tallow/-coco and coco/palm fatty acids having a substantial amount of $C_8$–$C_{12}$ fatty acids are not in accordance with the invention. They provided markedly inferior results in terms of being able to completely prevent pin-point spotting as reflected in the relative percentages of Class I versus Classes IV and V grading achieved with such bleaching agents.

Radiacid 60 and Rediacid 160 contain a percentage of $C_{20}$–$C_{22}$ fatty acids above 40%, by weight, are also not in accordance with the invention. They too provided markedly inferior results with regard to being able to completely prevent pin point spotting (Class I) relative to fatty acid HMW.

TABLE 2

| FATTY ACID TYPE | HMW TYPE I | HMW TYPE II | RADIACID 60 | RADI-ACID 161 | TALLOW/COCO | COCO/PALM | CONTROL (UNCOATED MMPP) |
|---|---|---|---|---|---|---|---|
| % COATING | 30 | 28 | 28 | 28 | 28 | 28 | 0 |
| CARBON CHAIN LENGTH DISTRIBUTION | | | | | | | |
| C18 to C22 (%) | 56.8 | 58.0 | 85 | 94 | 51.5 | 15 | — |
| C20 to C22 (%) | 28.3 | 17.1 | 55 | 50 | 1.0 | 0 | — |
| C8 to C16 (%) | 43.2 | 42.0 | 15 | 6 | 48.5 | 83 | — |
| C8 to C12 (%) | 0 | 0.4 | 0 | 0 | 15.0 | 57 | — |
| PIN POINT BLEACHING CLASS I | | | | | | | |
| Top (%) | 58.3 | 45.5 | 19 | 33.3 | 25 | 5.6 | 0 |
| Middle (%) | 75.0 | 45.5 | 19 | 41.7 | 20 | 33.3 | 61.3 |
| Bottom (%) | 87.5 | 59.1 | 28.6 | 54.2 | 85 | 38.9 | 67.7 |
| PIN POINT BLEACHING | | | | | | | |
| Top (class IV and V) (%) | 4.2 | 9.1 | 9.5 | 4.2 | 10 | 27.8 | 42.0 |

We claim:

1. A bleaching agent particularly effective for low temperature bleaching of laundry while substantially avoiding concomitant dye damage of bleach-sensitive dyed fabrics comprising: particles of monoperoxyphthalic acid, said particles being at least partially coated with an effective amount of a substantially aliphatic fatty acid mixture comprised of at least about 16% and no more than about 40%, by weight, of fatty acids having a chain length of from 20 to 22 carbon atoms, said mixture being substantially free of fatty acids having less than 14 carbon atoms.

2. The bleaching agent of claim 1 wherein the effective amount of said fatty acid mixture is from about 25 to 35%, by weight, of the coated particles of monoperoxyphthalic or the salt thereof.

3. The bleaching agent of claim 2 wherein the effective amount of said fatty acid mixture is from about 27 to 30%, by weight of said coated particles.

4. The bleaching agent of claim 1 wherein said fatty acid mixture contains from about 22% to about 34%, by weight, of fatty acids having a chain length of from 20 to 22 carbon atoms.

5. The bleaching agent of claim 4 wherein the amount of $C_{20}$–$C_{22}$ fatty acids in said fatty acid mixture is about 28%, by weight.

6. The bleaching agent of claim 1 which contains magnesium monoperoxyphthalate.

7. A bleaching detergent composition comprising:

(a) from about 5 to 50%, by weight, of a bleaching agent comprising particles of monoperoxyphthalic acid or a water-soluble salt thereof, said particles being at least partially coated with an effective amount of a substantially aliphatic fatty acid mixture comprised of at least about 16%, and no more than about 40%, by weight, of fatty acids having a chain length of from 20 to 22 carbon atoms, said mixture being substantially free of fatty acids having less than 14 carbon atoms.

(b) from about 5 to 50%, by weight, of one or more detergent surface active agents selected from the group consisting of anionic, cationic, nonionic, ampholytic and zwitterionic detergents;

(c) from about 5 to 80%, by weight, of a detergent builder salt; and (d) the balance comprising water and optionally a filler salt.

8. A bleaching detergent composition in accordance with claim 7 wherein the effective amount of said fatty acid mixture is from about 25 to 35%, by weight, of the coated particles of monoperoxyphthalic or the salt thereof.

9. A bleaching detergent composition in accordance with claim 8 wherein the amount of said fatty acid mixture is from about 27 to 30%, by weight, of said coated particles.

10. A bleaching detergent composition in accordance with claim 7 wherein said fatty acid mixture contains from about 22 to 34% by weight, of fatty acids having a chain length of from 20 to 22 carbon atoms.

11. A bleaching detergent composition in accordance with claim 7 wherein said bleaching agent contains magnesium monoperoxyphthalate.

12. A process for bleaching which is particularly effective for low temperature bleaching of laundry while substantially avoiding concomitant dye damage of bleach-sensitive dyed fabrics, which comprises contacting the stained and/or soiled fabrics to be bleached with an aqueous solution of a composition comprising particles of monoperoxyphthalic acid or a water-soluble salt thereof, said particles being at least partially coated with an effective amount of a substantially aliphatic fatty acid mixture comprised of at least about 16%, by weight, of fatty acids having a chain length of from 20 to 22 carbon atoms, said mixture being substantially free of fatty acids having less than 14 carbon atoms.

13. A process in accordance with claim 12 wherein the effective amount of said fatty acid mixture is from about 25 to 35%, by weight, of the coated particles of monoperoxyphthalic or the salt thereof.

14. A process in accordance with claim 13 wherein the amount of said fatty acid mixture is from about 27 to 30%, by weight, of said coated particles.

15. A process in accordance with claim 12 wherein said fatty acid mixture contains from about 22 to 34%, by weight, of fatty acids having s chain length of from 20 to 22 carbon atoms.

16. A process in accordance with claim 15 wherein the amount of $C_{20}$–$C_{22}$ fatty acids in said mixture is about 28%, by weight.

17. A process in accordance with claim 12 wherein said bleaching agent contains magnesium monoperoxyphthalate.

* * * * *